US011043172B2

(12) United States Patent
Slavenburg et al.

(10) Patent No.: US 11,043,172 B2
(45) Date of Patent: Jun. 22, 2021

(54) LOW-LATENCY HIGH-DYNAMIC RANGE LIQUID-CRYSTAL DISPLAY DEVICE

(71) Applicant: NVIDIA CORPORATION, Santa Clara, CA (US)

(72) Inventors: Gerrit Ary Slavenburg, Hayward, CA (US); Robert Jan Schutten, San Jose, CA (US); Jens Roever, Los Gatos, CA (US); Tom J. Verbeure, Sunnyvale, CA (US)

(73) Assignee: NVIDIA Corporation, Santa Clara, CA (US)

( * ) Notice: Subject to any disclaimer, the term of this patent is extended or adjusted under 35 U.S.C. 154(b) by 0 days.

(21) Appl. No.: 16/268,438

(22) Filed: Feb. 5, 2019

(65) Prior Publication Data

US 2019/0266961 A1 Aug. 29, 2019

Related U.S. Application Data

(60) Provisional application No. 62/636,130, filed on Feb. 27, 2018.

(51) Int. Cl.
*G09G 3/36* (2006.01)
*G09G 3/34* (2006.01)

(52) U.S. Cl.
CPC ..... *G09G 3/3426* (2013.01); *G09G 3/36* (2013.01); *G09G 2360/18* (2013.01)

(58) Field of Classification Search
CPC ..... G09G 2320/0646; G09G 3/3413; G09G 3/3648; G09G 2360/16; G09G 3/3406; G09G 3/36; G09G 2320/0233; G09G 2320/062; G09G 2320/0626; G09G 2320/0686; G09G 2310/0237; G09G 2320/064; G06T 15/506
See application file for complete search history.

(56) References Cited

U.S. PATENT DOCUMENTS 5,931,960 A 8/1999 Kletter
6,359,662 B1 3/2002 Walker
6,633,301 B1 10/2003 Dallas et al.
(Continued)

OTHER PUBLICATIONS

Non-Final Office Action received for U.S. Appl. No. 16/163,516 dated Nov. 19, 2019, 22 pages.
(Continued)

*Primary Examiner* — Hau H Nguyen
(74) *Attorney, Agent, or Firm* — Artegis Law Group, LLP

(57) ABSTRACT

A display controller progressively updates LEDs and LCD pixels in scanline order as portions of an image are scanned into a frame buffer. The display controller analyzes a first portion of the image that includes a first pixel value associated with a first LCD pixel. The display controller identifies a first LED that contributes luminance to the first LCD pixel and determines an LED current setting for the LED based on the first pixel value. The display controller then identifies a second LCD pixel that resides above the first LED and is associated with a second pixel value. The display controller configures the second LCD pixel based on the second pixel value and luminance contributions received at the second LCD pixel. Accordingly, the display controller need not wait for the entire image to be scanned into the frame buffer before initiating display of the image.

20 Claims, 7 Drawing Sheets

(56) References Cited

U.S. PATENT DOCUMENTS

| | | | | |
|---|---|---|---|---|
| 7,843,402 | B2 | 11/2010 | Nakadaira | |
| 8,059,070 | B2 | 11/2011 | Odawara | |
| 2002/0019970 | A1 | 2/2002 | Araki et al. | |
| 2005/0073845 | A1 | 4/2005 | Matsui | |
| 2006/0077489 | A1 | 4/2006 | Zhang et al. | |
| 2006/0107616 | A1 | 5/2006 | Ratti et al. | |
| 2006/0279522 | A1 | 12/2006 | Kurihara | |
| 2007/0027651 | A1 | 2/2007 | Ng et al. | |
| 2007/0211014 | A1 | 9/2007 | Kim et al. | |
| 2007/0268695 | A1 | 11/2007 | Seetzen | |
| 2009/0033612 | A1 | 2/2009 | Roberts et al. | |
| 2009/0174638 | A1 | 7/2009 | Brown et al. | |
| 2010/0110112 | A1 | 5/2010 | Nakanishi | |
| 2010/0134406 | A1 | 6/2010 | Maruyama et al. | |
| 2010/0134512 | A1 | 6/2010 | Kwon et al. | |
| 2010/0171690 | A1 | 7/2010 | Park et al. | |
| 2010/0225574 | A1 | 9/2010 | Fujiwara | |
| 2010/0253706 | A1* | 10/2010 | Shirouzu | G09G 3/2092 345/690 |
| 2010/0295879 | A1* | 11/2010 | Tanaka | G09G 3/3426 345/690 |
| 2010/0315445 | A1 | 12/2010 | An et al. | |
| 2011/0050760 | A1 | 3/2011 | Ito | |
| 2011/0069095 | A1 | 3/2011 | Kim et al. | |
| 2011/0096249 | A1 | 4/2011 | Belik et al. | |
| 2011/0122170 | A1 | 5/2011 | Kim et al. | |
| 2011/0141077 | A1 | 6/2011 | Cho | |
| 2011/0193896 | A1 | 8/2011 | Johnson | |
| 2011/0205259 | A1 | 8/2011 | Hagood, IV | |
| 2012/0051635 | A1 | 3/2012 | Kunkel et al. | |
| 2012/0075555 | A1 | 3/2012 | Parker et al. | |
| 2012/0093430 | A1 | 4/2012 | Sumi et al. | |
| 2012/0105509 | A1 | 5/2012 | Ito | |
| 2012/0154459 | A1 | 6/2012 | Otoi | |
| 2012/0154462 | A1 | 6/2012 | Hempson et al. | |
| 2013/0010016 | A1 | 1/2013 | Sasaki | |
| 2013/0314459 | A1 | 11/2013 | Nakanishi | |
| 2014/0327710 | A1 | 11/2014 | Xu et al. | |
| 2015/0070403 | A1 | 3/2015 | Kim | |
| 2015/0116378 | A1 | 4/2015 | Cho et al. | |
| 2016/0225301 | A1 | 8/2016 | Scepanovic et al. | |
| 2016/0344992 | A1 | 11/2016 | D'Alfonso et al. | |
| 2017/0132972 | A1 | 5/2017 | Tsuchida | |
| 2017/0223786 | A1 | 8/2017 | Petluri et al. | |
| 2018/0277059 | A1 | 9/2018 | Tomabechi | |
| 2018/0302651 | A1 | 10/2018 | Jacobson et al. | |
| 2018/0336397 | A1 | 11/2018 | Smith | |
| 2019/0107626 | A1 | 4/2019 | Matsuura | |
| 2019/0188917 | A1 | 6/2019 | Cho | |
| 2019/0266935 | A1 | 8/2019 | Roever | |
| 2019/0266959 | A1 | 8/2019 | Slavenburg | |
| 2019/0266961 | A1 | 8/2019 | Slavenburg | |

OTHER PUBLICATIONS

Notice of Allowance for U.S. Appl. No. 16/152,358, dated Nov. 20, 2019, 12 pages.
Ex-Parte Quayle Action received for U.S. Appl. No. 16/276,564, dated Mar. 31, 2020, 16 pages.
Non-Final Office Action received for U.S. Appl. No. 16/271,743 dated Jun. 22, 2020, 36 pages.
Notice of Allowance received for U.S. Appl. No. 16/271,744, dated Mar. 17, 2020, 28 pages.
Non-Final Office Action received for U.S. Appl. No. 16/163,515, dated Mar. 3, 2020, 40 pages.
Final Office Action received for U.S. Appl. No. 16/163,516 dated Jun. 1, 2020, 30 pages.
Notice of Allowance received for U.S. Appl. No. 16/276,564, dated Jul. 7, 2020, 46 pages.
Non-Final Office Action received for U.S. Appl. No. 16/828,850, dated Nov. 24, 2020, 50 pages.
Notice of Allowance received for U.S. Appl. No. 16/276,564, dated Sep. 11, 2020, 33 pages.
Notice of Allowance received for U.S. Appl. No. 16/276,564, dated Sep. 23, 2020, 5 pages.
Notice of Allowance received for U.S. Appl. No. 16/276,564, dated Nov. 12, 2020, 6 pages.
Non-Final Office Action received for U.S. Appl. No. 16/163,516 dated Sep. 24, 2020, 54 pages.
Non-Final Office Action received for U.S. Appl. No. 16/163,516 dated Dec. 16, 2020, 32 pages.
Final Office Action received for U.S. Appl. No. 16/163,515 dated Aug. 28, 2020, 37 pages.
Final Office Action received for U.S. Appl. No. 16/271,743 dated Oct. 14, 2020, 29 pages.
Non-Final Office Action received for U.S. Appl. No. 16/828,850, dated Nov. 24, 2020, 38 pages.
Non-Final Office Action received for U.S. Appl. No. 16/271,743 dated Feb. 19, 2021, 28 pages.

* cited by examiner

LOW-LATENCY HIGH-DYNAMIC RANGE LIQUID-CRYSTAL DISPLAY DEVICE

CROSS-REFERENCE TO RELATED APPLICATIONS

This application claims the priority benefit of the United States provisional patent application titled, "Low Latency Direct Backlit LCD HDR Display," filed on Feb. 27, 2018 and having Ser. No. 62/636,130. The subject matter of this related application is hereby incorporated herein by reference.

BACKGROUND

Field of the Various Embodiments

Embodiments of the present invention relate generally to display devices and display technology and, more specifically, to a low-latency high-dynamic range liquid-crystal display device.

Description of the Related Art

A conventional liquid-crystal display (LCD) usually includes an array of light-emitting diodes (LEDs) coupled to an array of LCD pixels. The array of LEDs is commonly known as the "backlight." In operation, the backlight emits light to the array of LCD pixels with a brightness that can vary across different LCD pixels. A given LCD pixel includes a set of filters, each with a light valve that can be set to a desired transparency to modify the color of the light received from the backlight and emit light having a specific color value.

In a typical system, a display controller coordinates the operations of the backlight and the array of LCD pixels to cause an image to be displayed via the LCD. To display an image, the display controller scans the image into a frame buffer and then analyzes the image to determine a brightness for each LED included in the backlight. The display controller sets the current supplied to each LED based on the determined brightness and configures each LCD pixel to emit light having a specific color value based on a portion or pixel of the image being displayed.

One drawback of the above approach is that the display controller waits until the entire image is scanned into the frame buffer before analyzing the image, thereby causing the image to be delayed by a full frame when finally output to the user. This delay is known in the art as "frame delay." Frame delay can be problematic in video game applications, where frames need to be rendered as fast as possible to provide visual feedback to a user based on user input. When visual feedback is delayed by a full frame, a video game can appear sluggish and/or unresponsive to user input, leading to a poor user experience.

Another drawback of the above approach is that the display controller updates the LEDs and LCD pixels separately, which can result in visual artifacts. In particular, if an LED is updated before a corresponding LCD is updated, then the LCD can briefly emit light with a noticeably incorrect brightness and/or color. One common approach for addressing this issue is to cause the LEDs to update more slowly. However, causing the LEDs to update more slowly adds additional delay, which can exacerbate the frame delay issues described above.

As the foregoing illustrates, what is needed in the art are more effective techniques for displaying images that address one or more of the above drawbacks.

SUMMARY

Various embodiments include a computer-implemented method for displaying an image, including buffering a first portion of an image that is at least partially scanned into a frame buffer, wherein the first portion of the image includes a first pixel value corresponding to a first screen pixel, computing a first current setting for a first light source based on the first pixel value, wherein the first light source, when illuminated, contributes luminance to both the first screen pixel and to a second screen pixel, and configuring the second screen pixel to emit light based on the first current setting and a second pixel value corresponding to the second screen pixel.

At least one technological advantage of the disclosed techniques relative to the prior art is that an image scanned into the frame buffer is progressively painted to the display screen without a full frame delay. Accordingly, the disclosed techniques are especially well-suited for gaming applications where the time between user input and graphical response should be minimized

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

In the following description, numerous specific details are set forth to provide a more thorough understanding of the various embodiments. However, it will be apparent to one skilled in the art that the inventive concepts may be practiced without one or more of these specific details.

As noted above, a conventional display controller waits until an entire image is scanned into the frame buffer before initiating the process of analyzing the image and configuring the LEDs and LCD pixels to display the image. Consequently, the image is delayed by at least a full frame when ultimately output via the display screen. Furthermore, a conventional display controller updates LEDs and LCD pixels separately, potentially causing visual artifacts caused by a mismatch between the LED brightness settings and the LCD pixel color settings.

To address these issues, various embodiments include a display controller that progressively updates LEDs and LCD pixels in scanline order as portions of an image are scanned into a frame buffer. The display controller analyzes a first portion of the image that includes a first pixel value associated with a first LCD pixel. The display controller identifies a first LED that contributes luminance to the first LCD pixel and determines an LED current setting for the LED based on the first pixel value. The display controller then identifies a second LCD pixel that resides above the first LED and is associated with a second pixel value. The display controller computes accumulated luminance contributions at the second LCD pixel from nearby LEDs, including the first LED. The display controller configures the second LCD pixel based on the second pixel value and the accumulated luminance contributions. While the second LCD pixel transitions between states, the display controller updates one or more LEDs associated with the second LCD pixel.

At least one technological advantage of the disclosed techniques relative to the prior art is that an image scanned into the frame buffer is progressively painted to the display screen without a full frame delay. Accordingly, the disclosed techniques are especially well-suited for gaming applications where the time between user input and graphical response should be minimized. Another technological advantage of the disclosed techniques relative to the prior art is that the LEDs are updated in relative synchrony with the LCD pixels, thereby minimizing or eliminating visual artifacts that arise when LEDs and LCD pixels are updated separately. The disclosed display controller is therefore especially useful for display devices designed for gaming and other high-performance applications. For these reasons, the disclosed techniques represent a significant technological advancement compared to previous approaches.

System Overview

Figure 1:
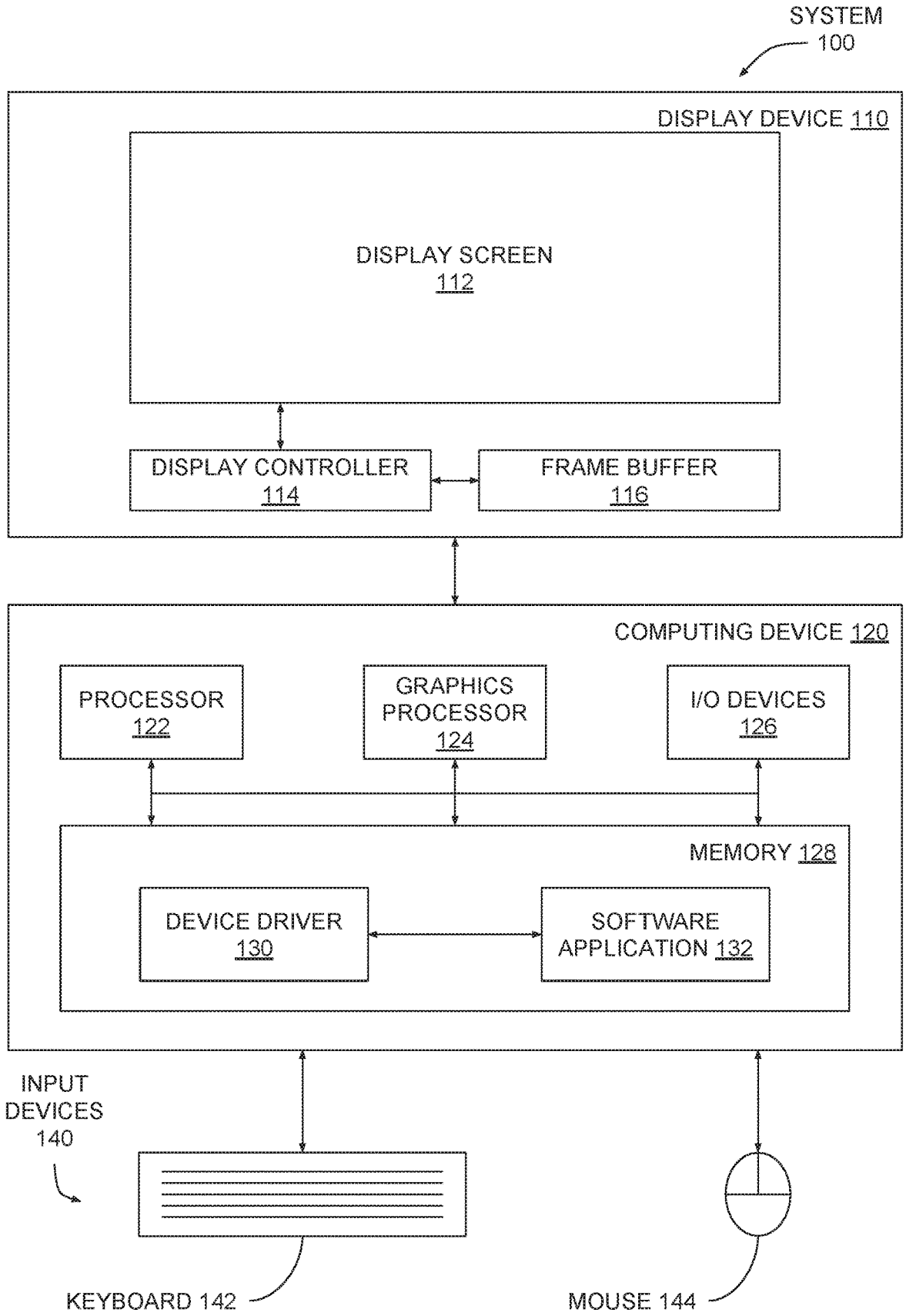
FIG. 1 illustrates a system configured to implement one or more aspects of the present invention.

FIG. 1 illustrates a system configured to implement one or more aspects of the present invention. As shown, system 100 includes a display device 110 coupled to a computing device 120. Computing device 120 is coupled to input devices 140 that include a keyboard 142 and a mouse 144. Display device 110 includes a display screen 112 and a display controller 114. In one embodiment, display device 110 is an LCD with an LED backlight configured for high dynamic range (HDR) output.

Computing device 120 includes a processor 122, a graphics processor 124, input/output (I/O) devices 126, and memory 128, coupled together. Processor 122 includes any technically feasible set of hardware units configured to process data and execute software applications. For example, processor 122 could include one or more central processing units (CPUs). Graphics processor 124 includes any technically feasible set of hardware units configured to process graphics data and execute graphics applications. For example, graphics processor 124 could include one or more graphics processing units (GPUs). I/O devices 126 include any technically feasible set of devices configured to perform input and/or output operations, including, for example, a universal serial bus (USB) port, among others. Memory 128 includes any technically feasible storage media configured to store data and software applications, such as, for example, a hard disk and/or a random-access memory (RAM) module, among others. Memory 128 includes a device driver 130 and a software application 132.

Device driver 130 includes program code that is executed by processor 122 to coordinate the operation of graphics processor 124. During execution, device driver 130 acts as an interface to graphics processor 124. Software application 132 includes program code that is executed by processor 122 to generate graphics processing tasks to be performed by graphics processor 124. In operation, software application 132 transmits these graphics processing tasks to device driver 130, and device driver 130 generates machine code that can be executed by graphics processor 124 to perform the graphics processing tasks. The graphics processing tasks could include, for example, graphics rendering operations, encoding operations, decoding operations, and so forth.

When performing graphics rendering operations, graphics processor 124 generates images on behalf of software application 132 and then causes display device 110 to display those images. For example, software application 132 could be a video game that leverages graphics processor 124 to render images depicting a simulated environment. Display device 110 could display these images to the user via display screen 112. Display screen 112 is described in greater detail below in conjunction with FIG. 2.

Figure 2:
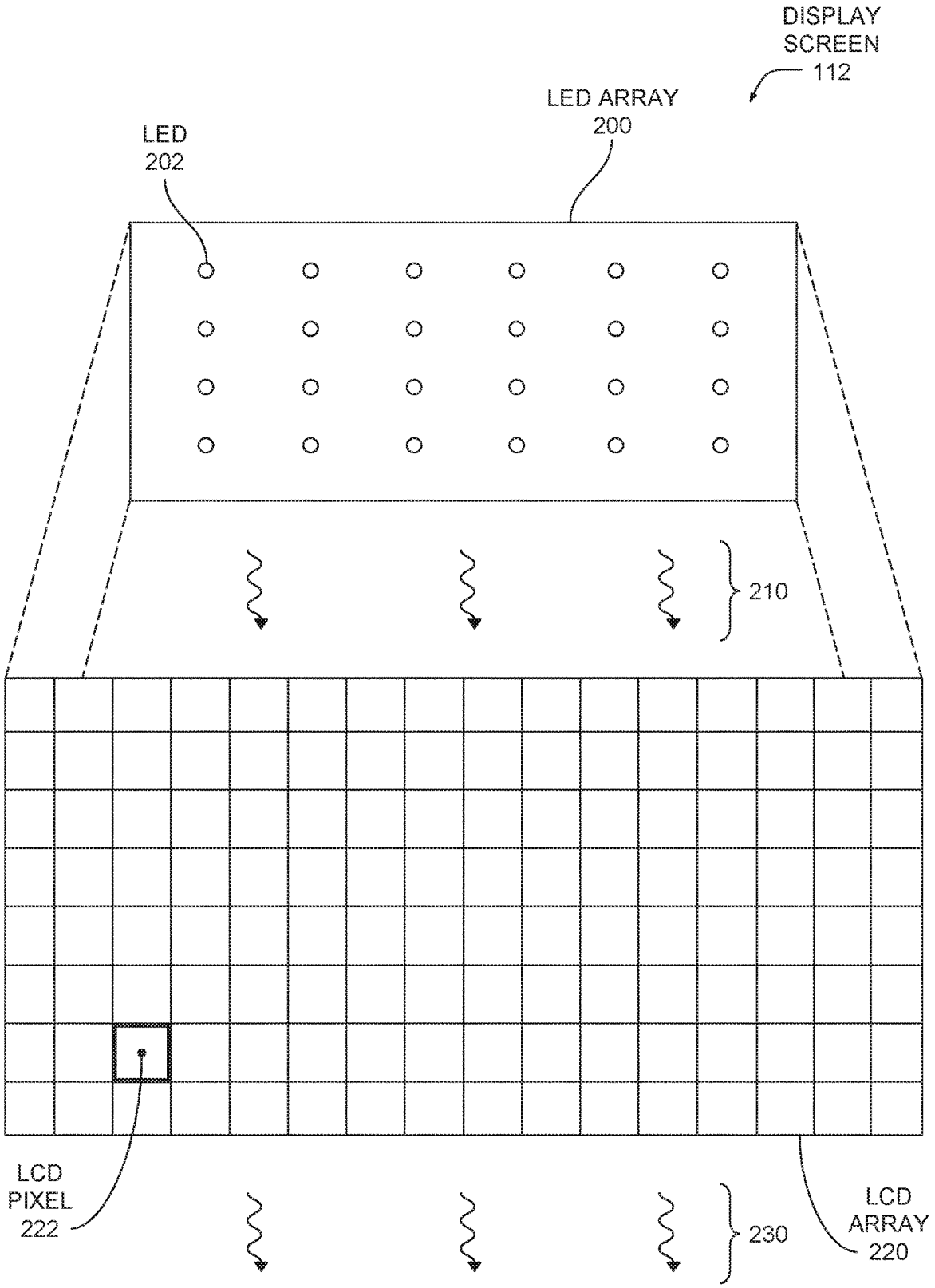
FIG. 2 is a more detailed illustration of the display screen of FIG. 1, according to various embodiments of the present invention.

FIG. 2 is a more detailed illustration of the display screen of FIG. 1, according to various embodiments of the present invention. As shown, display screen 112 includes an LED array 200 that includes a plurality of LEDs 202. LED array 200 may be known in the art as a "backlight." Display screen 112 also includes an LCD array 220 that includes a plurality of LCD pixels 222. LED array 200 is coupled to LCD array 220 and configured to emit light 210 to illuminate LCD array 220. LCD pixels 222 are at least partially translucent and therefore allow the re-transmission of any received light. Each LCD pixel 222 can be configured to filter the red, green, and blue (RGB) color components of light 210 and to then emit light 230 with a desired RGB color mix value. The operation of an exemplary LCD pixel 222 is described in greater detail below in conjunction with FIG. 3.

Figure 3:
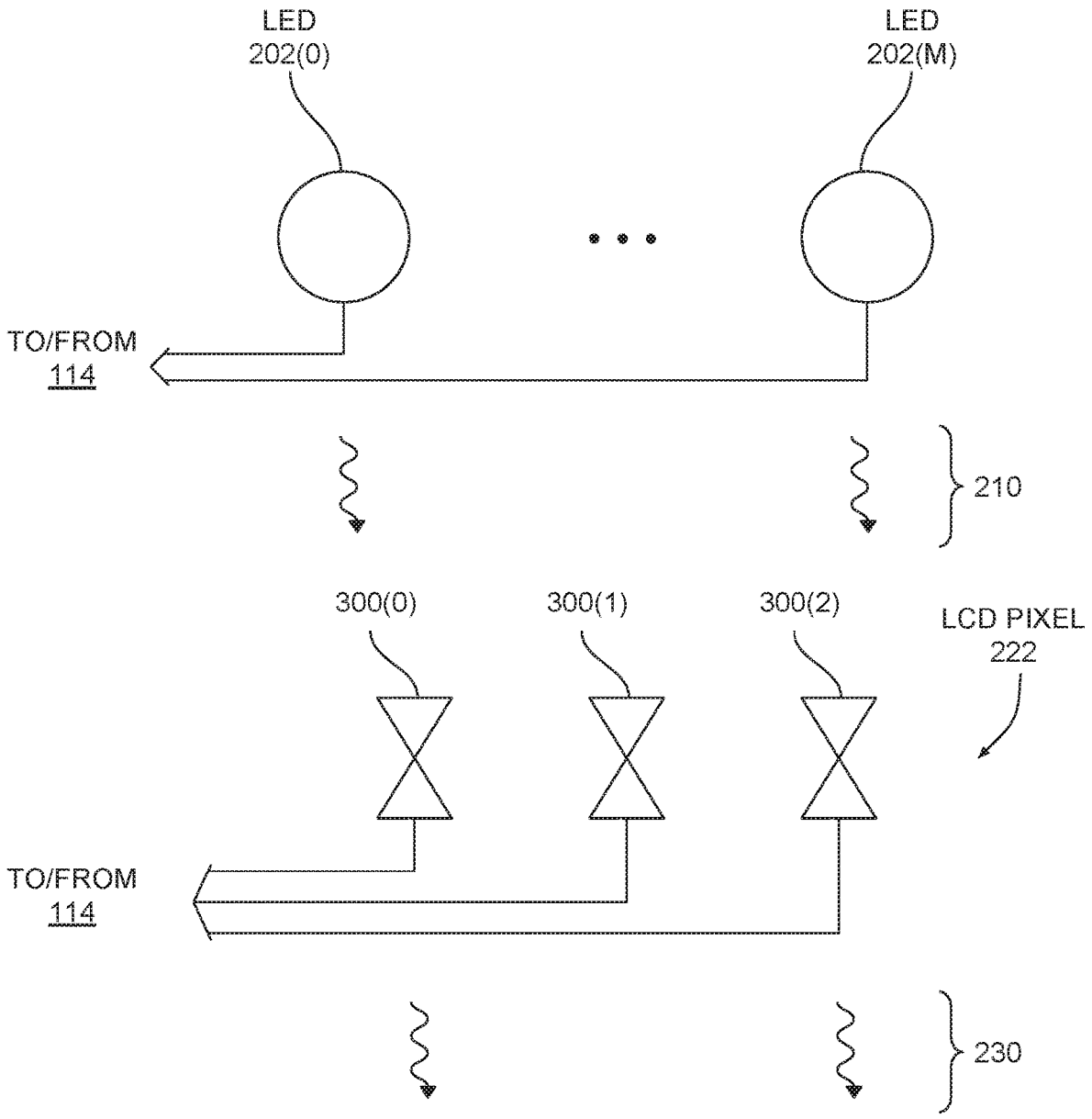
FIG. 3 is a more detailed illustration of one of the LCD pixels of FIG. 2, according to various embodiments of the present invention.

FIG. 3 is a more detailed illustration of an LCD pixel of FIG. 2, according to various embodiments of the present invention. As shown, an LCD pixel 222 includes valves 300(0), 300(1), and 300(2). A given valve 300 controls the amount of red, green, or blue light that is filtered by LCD pixel 222. In particular, valve 300(0) controls the filtering of red light, valve 300(1) controls the filtering of green light, and valve 300(2) controls the filtering of blue light. LCD pixel 222 receives light 210 from LEDs 202(0) through 202(M). LEDs 202(0) through 202(M) include some or all LEDs included in LED array 200. Based on the settings of valves 300, LCD pixel 222 filters light 210 and then outputs light 230 having a specific red, green, blue (RGB) color value.

Display controller 114 controls the brightness of LEDs 202 by supplying varying levels of current to each LED 202. For example, display controller 114 could cause an LED 202 to output light with an elevated brightness by supplying an elevated current level to that LED. Display controller 114 controls the color of light emitted by LCD pixel 222 by setting different percentages with which valves 300 should filter red, green, and blue light. For example, display controller 114 could cause LCD pixel 222 to output a purely blue light by setting valves 300(0) and 300(1) to filter 100% of red light and 100% of green light and filter 0% of blue light, thereby allowing only the blue component of light 210 to pass through LCD pixel 222 relatively unfiltered. As a general matter, display controller 114 controls the operation of LEDs 202 and LCD pixels 222 based on the image to be displayed, as described in greater detail below in conjunction with FIG. 4.

Figure 4:
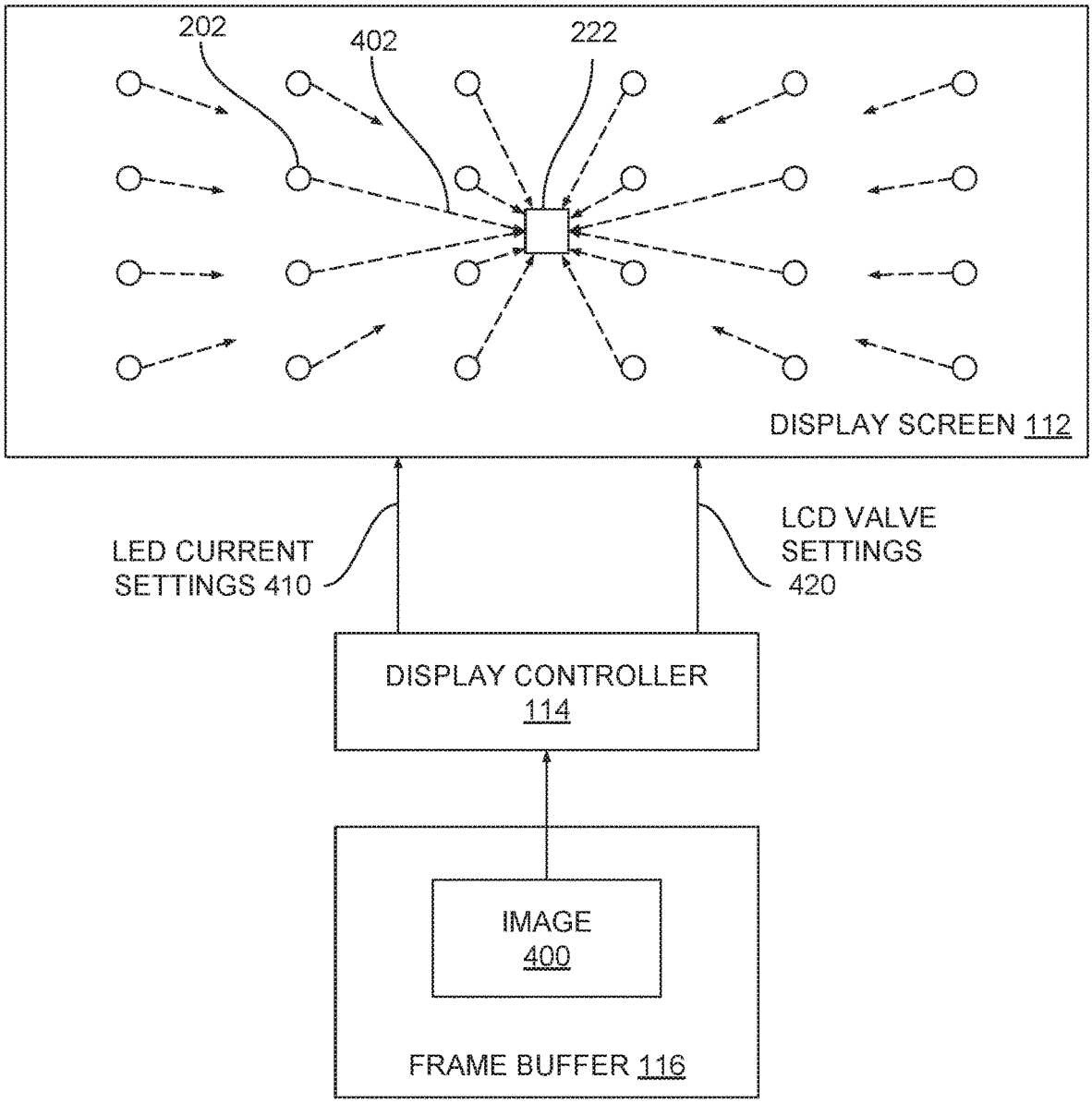
FIG. 4 illustrates how the display controller of FIG. 1 causes an image to be displayed, according to various embodiments of the present invention.

FIG. 4 illustrates how the display controller of FIG. 1 causes an image to be displayed, according to various embodiments of the present invention. As shown, display controller 114 receives some or all of an image 400 from frame buffer 116 and then generates LED current levels 410 and LCD valve settings 420. When generating LED current levels 410, display controller 114 performs an image processing operation with image 400 to determine a target brightness for each LED 202. Display controller 114 then determines the specific current level that should be supplied to each LED 202 to achieve the target brightness. When LEDs 202 are illuminated according to a given brightness setting, each LED 202 outputs light with a specific intensity, or luminance. Each LED 202 contributes a certain amount of this luminance to LCD pixel 222. As is shown, LED 202 generates a luminance contribution 402 that is received by LCD pixel 222.

When generating LCD valve settings 420 for image 400, display controller 114 maps each LCD pixel 222 to a different portion or pixel of image 400 to determine a target RGB color value for each LCD pixel 222. Display controller 114 also accumulates luminance contributions 402 provided by some or all LEDs 202 to each LCD pixel 222 to generate a backlight illumination field (BLIF). The BLIF is an array of values that indicates the total luminance received at each LCD pixel 222 when some or all LEDs 202 emit light based on the target brightness settings. Display controller 114 determines LCD valve settings 420 for LCD pixels 222 by dividing the target RGB color values by corresponding values included in the BLIF.

In order to cause display screen 112 to display image 400 with low latency, display controller 114 performs the technique described above progressively while image 400 is being written into frame buffer 116. In particular, display controller 114 progressively updates LEDs 202 and LCD pixels 222 in scanline order based on progressively received lines of image 400. An advantage of this approach is that display controller 114 avoids introducing a frame delay when displaying image 400. This approach is described in greater detail below in conjunction with FIG. 5.

Progressively Updating LEDs and LCD Pixels Based on Portions of an Image

Figure 5:
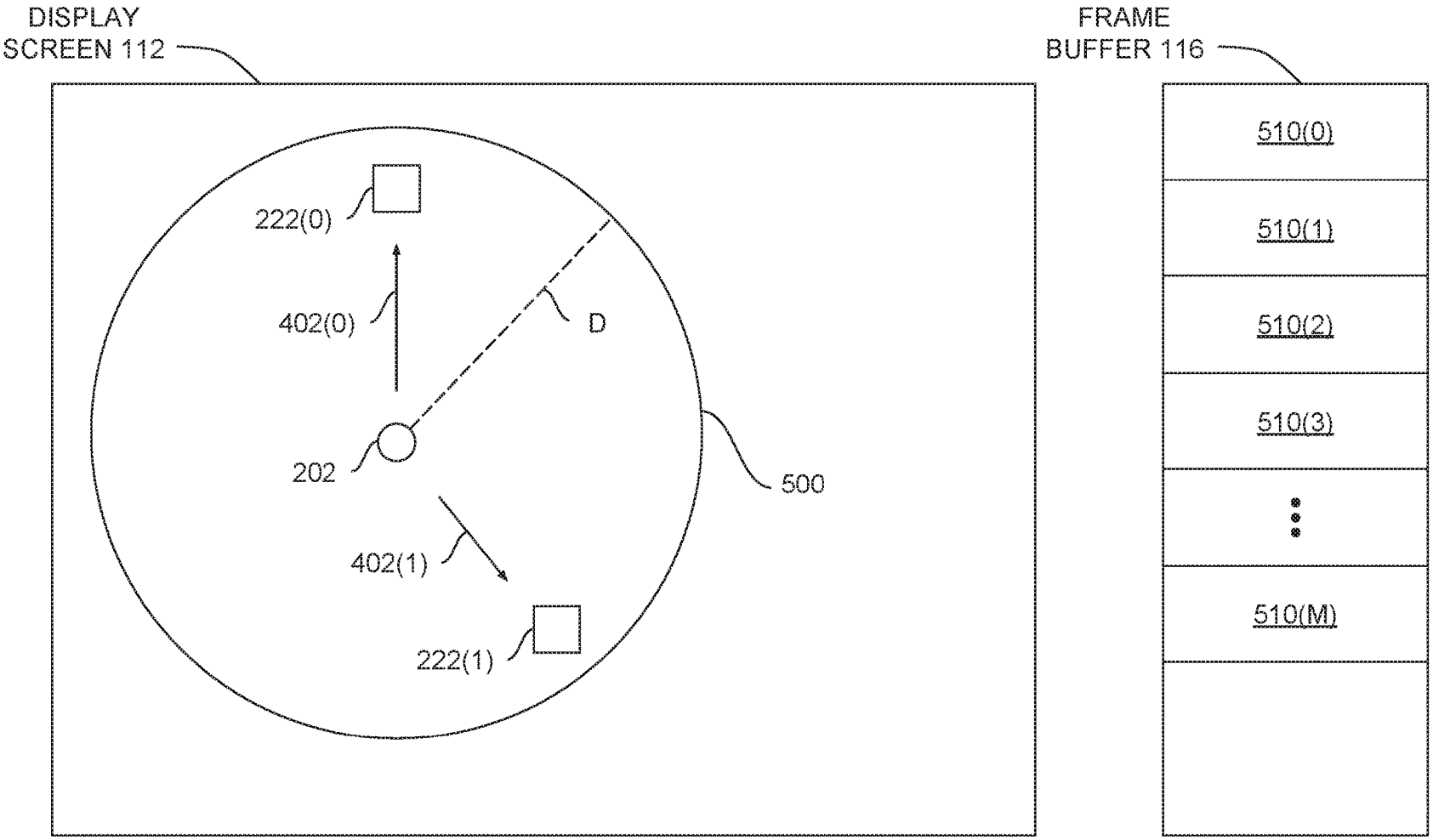
FIG. 5 illustrates how the display controller of FIG. 1 configures an LED and an LCD pixel based on a portion of an image, according to various embodiments of the present invention.

FIG. 5 illustrates how the display controller of FIG. 1 configures an LED and an LCD pixel based on a portion of an image, according to various embodiments. As shown, display screen 112 includes LED 202 that contributes luminance to LCD pixels 222 falling within a region 500 of display screen 112. Region 500 is circular and has a radius D. LCD pixels 222(0) and 222(1) reside within region 500. When illuminated, LED 202 is configured to provide a luminance contribution 402(0) to LCD pixel 222(0) and to provide a luminance contribution 402(1) to LCD pixel 222(1). LCD pixel 222(0) generally resides above LED 202 within display screen 112. LCD pixel 222(1) generally resides below LED 202 within display screen 112. In one embodiment, LED 202 may be included in a neighborhood of LEDs that surrounds LCD pixel 222(1) and collectively provides sufficient luminance to cause LCD pixel 222(1) to achieve a desired brightness.

As also shown, frame buffer 116 includes lines 510(0) through 510(M) of image 400. During operation, frame buffer 116 progressively receives lines 510 of image 400 from graphics processor 124 in scanline order. Each line 510 includes pixel values associated with the various LCD pixels 222 included in display screen 112. For example, line 510(0) could include a pixel value corresponding to LCD pixel 222(0), and line 510(M) could include another pixel value corresponding to LCD pixel 222(1).

The LCD valve setting for a given LCD pixel depends on the corresponding pixel value as well as the accumulated luminance contributions received from nearby LEDs 202, as discussed above in conjunction with FIG. 4. Accordingly, the LCD valve setting for LCD pixel 222(0) depends on the corresponding pixel value and luminance contribution 402(0) received from LED 202. Luminance contribution 402(0), in turn, depends on the particular LED current setting 410 associated with LED 202. Display controller 114 determines the LED current setting 410 for LED 202 based, at least in part, on a luminance component of the pixel value associated with LCD pixel 222(1). For example, suppose the pixel value corresponding to LCD 222(1) has a high luminance component. Display controller 114 would determine that LED 202 should have a correspondingly high current setting 410 in order to contribute an elevated amount of luminance to LCD pixel 222(1).

Once frame buffer 116 receives a line 510 that includes the pixel value corresponding to LCD pixel 222(1), display controller 114 computes the LED current setting 410 for LED 202 and computes the LCD valve setting for LCD pixel 222(0). Then, display controller updates LED 202 and LCD pixel 222(0) based on the computed settings, thereby causing LED 202(0) to emit light corresponding to a portion of image 400. In this manner, display controller 114 is capable of progressively displaying portions of image 400 as those portions are scanned into frame buffer 116.

One advantage of the approach described above is that display controller 114 begins painting pixels associated with image 400 to display screen 112 as soon as sufficient pixel values are available to do so. In the example described above, display controller 114 can begin configuring LCD pixel 222(0) once the pixel value associated with LCD pixel 222(1) is available. Accordingly, display controller 114 avoids introducing a full frame delay and can therefore output image with very low latency. When updating LEDs 202 and LCD pixels 222, display controller 114 performs an additional technique to minimize the appearance of visual artifacts, as described in greater detail below in conjunction with FIG. 6.

Coordinating LED Updates with LCD Pixel Updates

Figure 6:
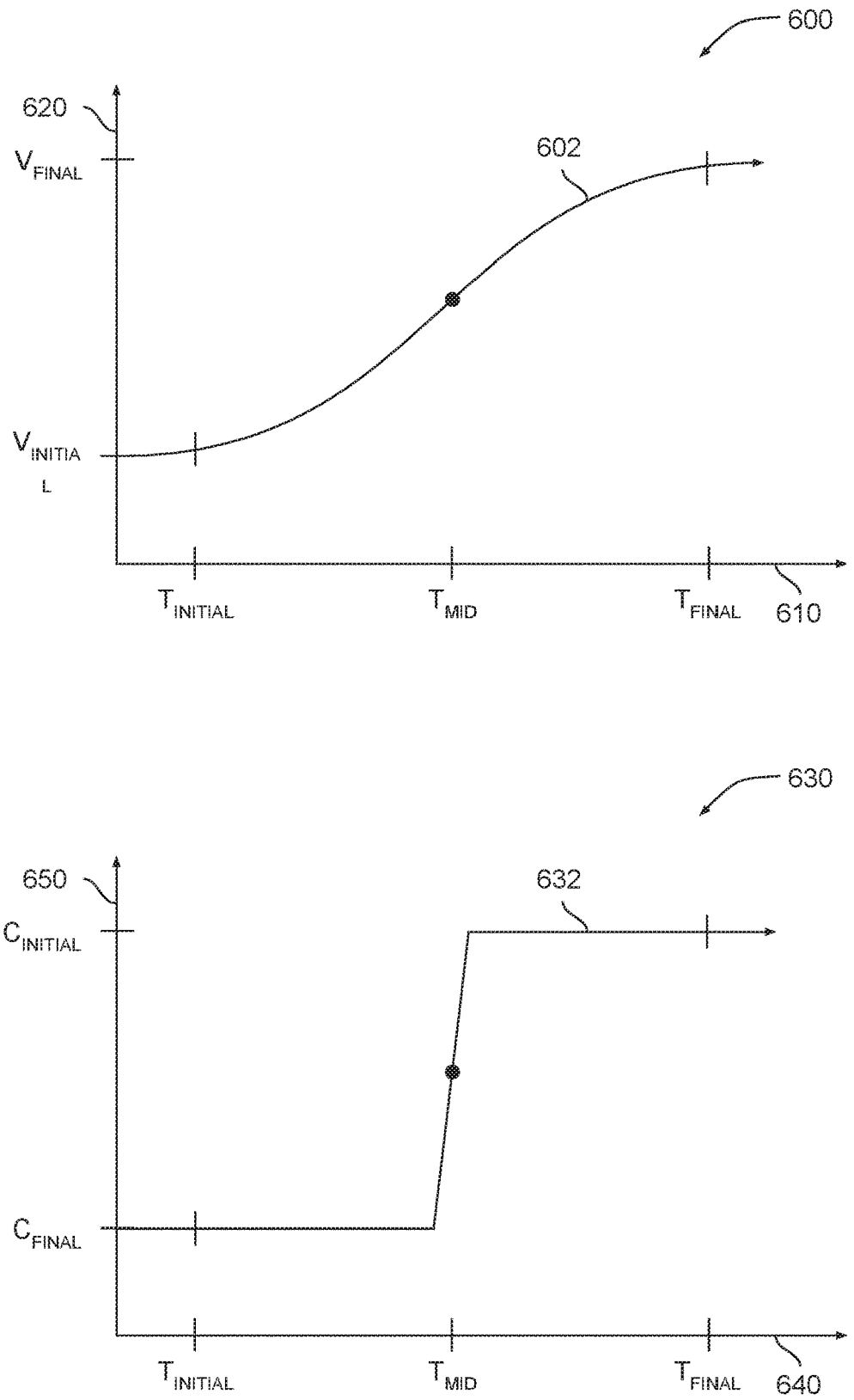
FIG. 6 illustrates how the display controller of FIG. 1 coordinates updating an LED with updating a corresponding LCD pixel, according to various embodiments of the present invention.

FIG. 6 illustrates how the display controller of FIG. 1 coordinates updating an LED with updating a corresponding LCD pixel, according to various embodiments of the present invention. As shown, a graph 600 includes a plot 602 that indicates a valve configuration for an LCD pixel 222 as a function of time. Graph 600 includes time axis 610 and valve configuration axis 620. When configuring display screen 112 to display an image, display controller 114 transitions the valve configuration for the LCD pixel 222 from an initial valve configuration $V_{initial}$ to a final valve configuration $V_{final}$. The transition occurs during an interval between an initial time $T_{initial}$ and a final time $T_{final}$. Midway through the transition, at time $T_{mid}$, the LCD pixel 222 is partially configured.

As also shown, a graph 630 includes a plot 632 that indicates a current setting for an LED 202 as a function of time. Graph 630 includes time axis 640 and current setting axis 650. When configuring display screen 112 to display an image, display controller 114 transitions the current setting for the LED 202 from an initial current setting $C_{initial}$ to a final current setting $C_{final}$. The transition occurs within a short subinterval between $T_{initial}$ and $T_{final}$ that is centered around $T_{mid}$.

The LCD pixel 222 associated with graph 600 and the LED 202 associated with graph 630 reside proximate to one another within display screen 112. In addition, the LED 202 is configured to illuminate the LCD pixel 222. Display controller 114 coordinates configuring the LCD pixel 222 and configuring the LED 202 in order to avoid visual artifacts that can arise when LCD pixels and corresponding LEDs are configured at different times. Specifically, because the LED 202 can be configured much faster than the LCD pixel 222 can be configured, as is shown, display controller 114 initiates configuring the LED 202 when the LCD pixel 222 is about halfway configured (around $T_{mid}$). As referred to herein, a configuration may be considered approximately halfway complete when anywhere between 40% and 60% complete.

In one embodiment, display controller 114 may configure one or more LEDs 202 that contribute luminance to the LCD pixel 222 when the configuration of a certain number of other LCD pixels 222 is complete. For example, display controller 114 could wait until a first half of the LCD pixels 222 that reside between two rows of LEDs 202 are configured and then configure one of those rows of LEDs 202 to illuminate the first half of the LCD pixels 222.

In another embodiment, display controller 114 may cause LEDs 202 to increase brightness rapidly according to a step function such as that shown in graph 630, but then subsequently cause those LEDs 202 to decrease brightness slowly with a specified decay rate. This approach can cause display screen 112 to appear more responsive because the brightness of display screen 112 can change rapidly. This approach also reduces or eliminates visual artifacts because decreasing brightness slowly provides the LCD pixels 222 with sufficient time to be configured to emit correct color values.

Referring generally to FIGS. 5-6, the two techniques described with respect to these two Figures advantageously allow display controller 114 to output images via display screen 112 with minimal frame delay and minimal visual artifacts. Accordingly, display controller 114 in particular, and display device 110 in general, are especially well-suited to high-performance interactive applications, such as gaming, where images can change rapidly based on user input.

Progressively Updating LCD Pixels in Conjunction with LEDs

Figure 7:
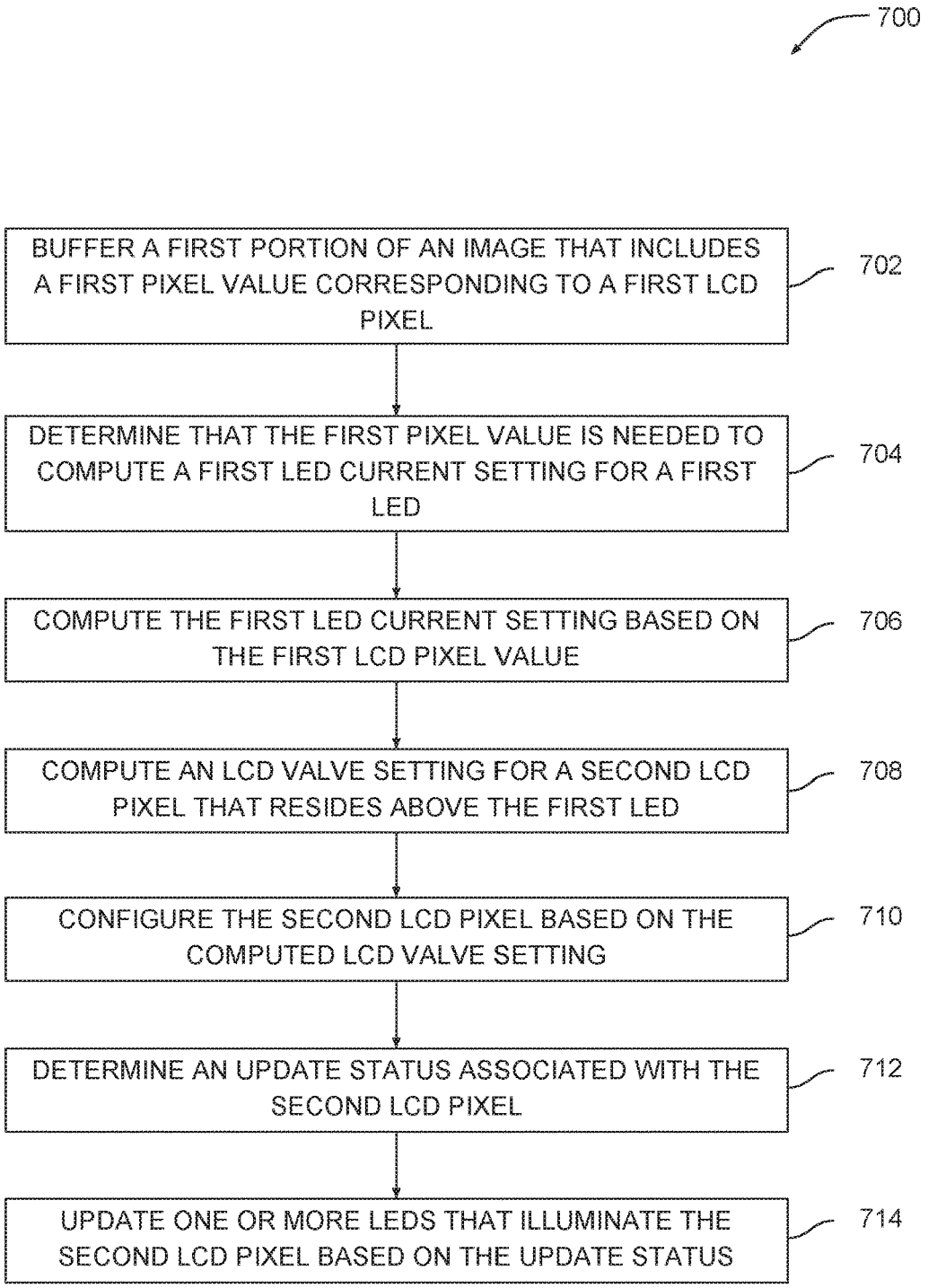
FIG. 7 is a flow diagram of method steps for updating an LED and an LCD pixel based on a portion of an image, according to various embodiments of the present invention.

FIG. 7 is a flow diagram of method steps for updating an LED and an LCD pixel based on a portion of an image, according to various embodiments of the present invention. Although the method steps are described in conjunction with the systems of FIGS. 1-6, persons skilled in the art will understand that any system configured to perform the method steps in any order falls within the scope of the present invention.

As shown, a method 700 begins at step 702, where frame buffer 116 of FIG. 1 buffers a first portion of an image that includes a first pixel value corresponding to a first LCD pixel. For example, frame buffer 116 could buffer a line 510 of image 400 that includes a pixel value corresponding to LCD pixel 222(1). Frame buffer 116 may also buffer other portions of image 400 instead of lines, including pixels, for example.

At step 704, display controller 114 determines that the first pixel value is needed to compute a first LED current setting for a first LED. The first LED provides significant luminance contributions to LCD pixels within a specific radius around the first LED, including the first LCD pixel. Thus, the first LED current setting for the first LED is computed based on the first pixel value. Accordingly, display controller 114 waits until frame buffer 116 includes the first pixel value before computing the first LED current setting for the first LED. In one embodiment, the first LED may reside before the first LCD pixel in a scanline order associated with display screen 112.

At step 706, display controller 114 computes the first LED current setting based on the first pixel value. In one embodiment, the first pixel value may indicate that the first LCD pixel should have a maximum brightness level. The first LCD pixel can achieve the maximum brightness level when one or more LEDs near the first LCD pixel collectively provide luminance contributions to the first LCD pixel. For example, the first LCD pixel could achieve the maximum brightness level when a 3×3 neighborhood of LEDs surrounding the first LCD pixel provide luminance contributions to the first LCD pixel.

At step 708, display controller 114 computes an LCD valve setting for a second LCD pixel that resides above the first LED. The second LCD pixel receives a luminance contribution from the first LED that is based on the first LED current setting computed at step 706. This luminance contribution influences the computation of the LCD valve setting for the second LCD pixel. Because the first LED current setting depends on the first pixel value associated with the first LCD pixel, display controller 114 can compute the LCD valve setting for the second LCD pixel after the frame buffer stores the first portion of the image at step 702.

At step 710, display controller 114 configures the second LCD pixel based on the computed LCD valve setting. Importantly, display controller 114 can configure the second LCD pixel before the entire image is scanned into frame buffer 116, unlike conventional display controllers that introduce a frame delay and wait for the entire image to be scanned into the frame buffer. This approach advantageously allows images to be progressively scanned into the frame buffer and incrementally painted to display device 112 with low latency. Images displayed in this manner may appear more responsive to user input.

At step 712, display controller 114 determines an update status associated with the second LCD pixel. In some cases, LCD pixels are configured more slowly than LEDs are configured. In order to synchronize the configuration of the second LCD pixel with the configuration of the first LED, display controller 114 monitors transitioning of the second LCD pixel and determines when the second LCD pixel has at least partially transitioned to the LCD valve setting determined at step 708 and configured at step 710. In one embodiment, the second LCD pixel transitions between LCD valve settings over a first interval of time, and display controller 114 determines the update status to indicate when approximately half of the first interval has occurred.

At step 714, display controller updates one or more LEDs that illuminate the second LCD pixel based on the update status determined at step 710. As mentioned above, display controller 114 determines when the second LCD pixel has at least partially transitioned to the LCD valve setting determined and configured via steps 706 and 708, respectively. Display controller 114 updates the one or more LEDs that illuminate the second LCD pixel during configuration of the second LCD pixel in order to avoid visual artifacts that may occur when LCD pixels and LEDs are updated or configured at different times.

In sum, a display controller progressively updates LEDs and LCD pixels in scanline order as portions of an image are scanned into a frame buffer. The display controller analyzes a first portion of the image that includes a first pixel value associated with a first LCD pixel. The display controller identifies a first LED that contributes luminance to the first LCD pixel and determines an LED current setting for the LED based on the first pixel value. The display controller then identifies a second LCD pixel that resides above the first LED and is associated with a second pixel value. The display controller computes accumulated luminance contributions at the second LCD pixel from nearby LEDs, including the first LED. The display controller configures the second LCD pixel based on the second pixel value and the accumulated luminance contributions. During configuration of the second LCD pixel, the display controller updates one or more LEDs associated with the second LCD pixel.

At least one technological advantage of the disclosed techniques relative to the prior art is that an image scanned into the frame buffer is progressively painted to the display screen without a full frame delay. Accordingly, the disclosed techniques are especially well-suited for gaming applications where the time between user input and graphical response should be minimized. Another technological advantage of the disclosed techniques relative to the prior art is that the LEDs are updated in relative synchrony with the LCD pixels, thereby reducing or eliminating the visual artifacts that can arise when LEDs and LCD pixels are updated separately. The disclosed display controller is therefore especially useful for display devices designed for gaming and other high-performance applications. These technological advantages represent one or more technological advancements relative to prior art designs and approaches.

1. Some embodiments include a computer implemented method for displaying an image, the method comprising buffering a first portion of an image that is at least partially scanned into a frame buffer, wherein the first portion of the image includes a first pixel value corresponding to a first screen pixel, computing a first current setting for a first light source based on the first pixel value, wherein the first light source, when illuminated, contributes luminance to both the first screen pixel and to a second screen pixel, and configuring the second screen pixel to emit light based on the first current setting and a second pixel value corresponding to the second screen pixel.

2. The computer-implemented method of clause 1, further comprising determining a transition status associated with the second screen pixel, and causing one or more light sources to illuminate the second screen pixel based on the transition status.

3. The computer-implemented method of any of clauses 1-2, further comprising causing the first light source to illuminate the second screen pixel when configuring the second screen pixel.

4. The computer-implemented method of any of clauses 1-3, further comprising causing the first light source to be illuminated based on the first current setting when the second screen pixel is approximately halfway transitioned.

5. The computer-implemented method of any of clauses 1-4, further comprising causing the first light source to illuminate the second screen pixel before illuminating the first screen pixel.

6. The computer-implemented method of any of clauses 1-5, wherein the first screen pixel resides below the first light source within a display screen, and the second screen pixel resides above the first light source within the display screen.

7. The computer-implemented method of any of clauses 1-6, wherein the first screen pixel resides after the first light source in a scanline order associated with a display screen, and the second screen pixel resides before the first light source in the scanline order associated with the display screen.

8. The computer-implemented method of any of clauses 1-7, wherein the first screen pixel emits light with a maximum brightness level when a neighborhood of light sources surrounding the first screen pixel and including the first light source is illuminated.

9. The computer-implemented method of any of clauses 1-8, wherein the first portion of the image comprises a line of pixels.

10. The computer-implemented method of any of clauses 1-9, wherein the first portion of the image comprises a first pixel.

11. Some embodiments include a display device, comprising a display screen, and a display controller that causes the display screen to display an image by performing the steps of buffering a first portion of an image that is at least partially scanned into a frame buffer, wherein the first portion of the image includes a first pixel value corresponding to a first screen pixel, computing a first current setting for a first light source based on the first pixel value, wherein the first light source, when illuminated, contributes luminance to both the first screen pixel and to a second screen pixel, and configuring the second screen pixel to emit light based on the first current setting and a second pixel value corresponding to the second screen pixel.

12. The display device of clause 11, wherein the display controller performs the additional steps of determining a transition status associated with the second screen pixel, and causing one or more light sources to illuminate the second screen pixel based on the transition status.

13. The display device of any of clauses 11-12, wherein the display controller performs the additional step of causing the first light source to illuminate the second screen pixel when configuring the second screen pixel.

14. The display device of any of clauses 11-13, wherein the display controller performs the additional step of causing the first light source to be illuminated based on the first current setting when the second screen pixel is approximately halfway transitioned.

15. The display device of any of clauses 11-14, wherein the display controller performs the additional steps of causing the first light source to illuminate the second screen pixel before the first screen pixel is fully illuminated.

16. The display device of any of clauses 11-15, wherein the first screen pixel resides below the first light source within the display screen, and the second screen pixel resides above the first light source within the display screen.

17. The display device of any of clauses 11-16, wherein the first screen pixel resides before the first light source in a scanline order associated with the display screen, and the second screen pixel resides after the first light source in the scanline order associated with the display screen.

18. The display device of any of clauses 11-17, wherein the first screen pixel emits light with a maximum brightness level when a neighborhood of light sources surrounding the first screen pixel and including the first light source is illuminated.

19. The display device of any of clauses 11-18, wherein the first portion of the image comprises a pixel or a line of pixels.

20. Some embodiments include a subsystem for displaying an image, the subsystem comprising a frame buffer that buffers a first portion of an image that is at least partially received from a processor, wherein the first portion of the image includes a first pixel value corresponding to a first screen pixel, and a display controller that computes a first current setting for a first light source based on the first pixel value, wherein the first light source, when illuminated, contributes luminance to both the first screen pixel and to a second screen pixel, and configures the second screen pixel to emit light based on the first current setting and a second pixel value corresponding to the second screen pixel.

Any and all combinations of any of the claim elements recited in any of the claims and/or any elements described in this application, in any fashion, fall within the contemplated scope of the present invention and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A computer implemented method for displaying an image, the method comprising:

buffering a first portion of an image that is at least partially scanned into a frame buffer, wherein the first portion of the image includes a first pixel value corresponding to a first screen pixel;

computing a first current setting for a first light source based on the first pixel value, wherein the first light source, when illuminated, contributes emitted light to both the first screen pixel and to a second screen pixel; and configuring the second screen pixel to emit light based on a first amount of emitted light contributed to the second screen pixel by the first light source and a second pixel value corresponding to the second screen pixel.

2. The computer-implemented method of claim 1, further comprising:

determining a transition status associated with the second screen pixel; and causing one or more light sources to illuminate the second screen pixel based on the transition status.

3. The computer-implemented method of claim 1, further comprising causing the first light source to illuminate the second screen pixel when configuring the second screen pixel.

4. The computer-implemented method of claim 1, further comprising causing the first light source to be illuminated based on the first current setting when the second screen pixel is approximately halfway transitioned.

5. The computer-implemented method of claim 1, further comprising causing the first light source to illuminate the second screen pixel before illuminating the first screen pixel.

6. The computer-implemented method of claim 1, wherein the first screen pixel resides below the first light source within a display screen, and the second screen pixel resides above the first light source within the display screen.

7. The computer-implemented method of claim 1, wherein the first screen pixel resides after the first light source in a scanline order associated with a display screen, and the second screen pixel resides before the first light source in the scanline order associated with the display screen.

8. The computer-implemented method of claim 1, wherein the first screen pixel emits light with a maximum brightness level when a neighborhood of light sources surrounding the first screen pixel and including the first light source is illuminated.

9. The computer-implemented method of claim 1, wherein the first portion of the image comprises a line of pixels.

10. The computer-implemented method of claim 1, wherein the first portion of the image comprises a first pixel.

11. A display device, comprising:

a display screen; and a display controller that causes the display screen to display an image by performing the steps of:

buffering a first portion of an image that is at least partially scanned into a frame buffer, wherein the first portion of the image includes a first pixel value corresponding to a first screen pixel;

computing a first current setting for a first light source based on the first pixel value, wherein the first light source, when illuminated, contributes emitted light to both the first screen pixel and to a second screen pixel; and configuring the second screen pixel to emit light based on a first amount of emitted light contributed to the second screen pixel by the first light source and a second pixel value corresponding to the second screen pixel.

12. The display device of claim 11, wherein the display controller performs the additional steps of:

determining a transition status associated with the second screen pixel; and causing one or more light sources to illuminate the second screen pixel based on the transition status.

13. The display device of claim 11, wherein the display controller performs the additional step of causing the first light source to illuminate the second screen pixel when configuring the second screen pixel.

14. The display device of claim 11, wherein the display controller performs the additional step of causing the first light source to be illuminated based on the first current setting when the second screen pixel is approximately halfway transitioned.

15. The display device of claim 11, wherein the display controller performs the additional steps of:

causing the first light source to illuminate the second screen pixel before the first screen pixel is fully illuminated.

16. The display device of claim 11, wherein the first screen pixel resides below the first light source within the display screen, and the second screen pixel resides above the first light source within the display screen.

17. The display device of claim 11, wherein the first screen pixel resides before the first light source in a scanline order associated with the display screen, and the second screen pixel resides after the first light source in the scanline order associated with the display screen.

18. The display device of claim 11, wherein the first screen pixel emits light with a maximum brightness level when a neighborhood of light sources surrounding the first screen pixel and including the first light source is illuminated.

19. The display device of claim 11, wherein the first portion of the image comprises a pixel or a line of pixels.

20. A subsystem for displaying an image, the subsystem comprising:

a frame buffer that buffers a first portion of an image that is at least partially received from a processor, wherein the first portion of the image includes a first pixel value corresponding to a first screen pixel; and a display controller that:

computes a first current setting for a first light source based on the first pixel value, wherein the first light source, when illuminated, contributes emitted light to both the first screen pixel and to a second screen pixel, and configures the second screen pixel to emit light based on a first amount of emitted light contributed to the second screen pixel by the first light source and a second pixel value corresponding to the second screen pixel.

* * * * *